US005530766A

United States Patent [19]

Hong et al.

[11] Patent Number: 5,530,766

[45] Date of Patent: Jun. 25, 1996

[54] NOISE REDUCING APPARATUS OF A CYCLO-FAN

[75] Inventors: Young K. Hong, Anyang; Young D. Bae, Suwon, both of Rep. of Korea

[73] Assignee: SamSung Electronics Co., LTD., Suwon, Rep. of Korea

[21] Appl. No.: 382,810

[22] Filed: Feb. 2, 1995

[30] Foreign Application Priority Data

Feb. 19, 1994 [KR] Rep. of Korea ..... 94-2977

[51] Int. Cl.[6] ..... G10K 11/16

[52] U.S. Cl. ..... 381/71; 415/119

[58] Field of Search ..... 381/71; 415/119

[56] References Cited

U.S. PATENT DOCUMENTS

| | | | |
|---|---|---|---|
| 4,180,329 | 12/1979 | Hildebrand et al. | 356/375 |
| 4,887,087 | 12/1989 | Clearwater | 342/61 |
| 5,355,417 | 10/1994 | Burdisso et al. | 381/71 |

FOREIGN PATENT DOCUMENTS

4/281125 10/1992 Japan .

*Primary Examiner*—Forester W. Isen
*Attorney, Agent, or Firm*—Burns, Doane, Swecker & Mathis

[57] ABSTRACT

A noise reducing apparatus for a cyclo-fan is provided for the canceling of a whistling noise with a specific frequency, determined by the product of the rotation number of the cyclo-fan and the number of blades thereof. The apparatus comprises a cyclo-fan including a plurality of blades with arc shapes radially disposed centering the axis thereof, and a couple of supporting members for supporting both ends of the respective blade; a sensor for the passage of the respective blade at a fixed position; a controller for calculating the frequency and pressure level of a peculiar noise generated by the cyclo-fan based on the signal transmitted from the sensor, and then generating an electric signal corresponding to the interference sound having a reverse phase and same pressure level to that the peculiar noise, and a plurality of speakers for converting the electric signal from the controller into the interference sound. The controller calculates the frequency of the peculiar noise by multiplying the rotation number of the cyclo-fan and the number of blades. In addition, the pressure of the peculiar noise is determined in proportion to the interval between the cyclo-fan and the stabilizer for guiding air generated from the cyclo-fan. The latter may be previously given as a constant value.

4 Claims, 7 Drawing Sheets

FIG. 8A
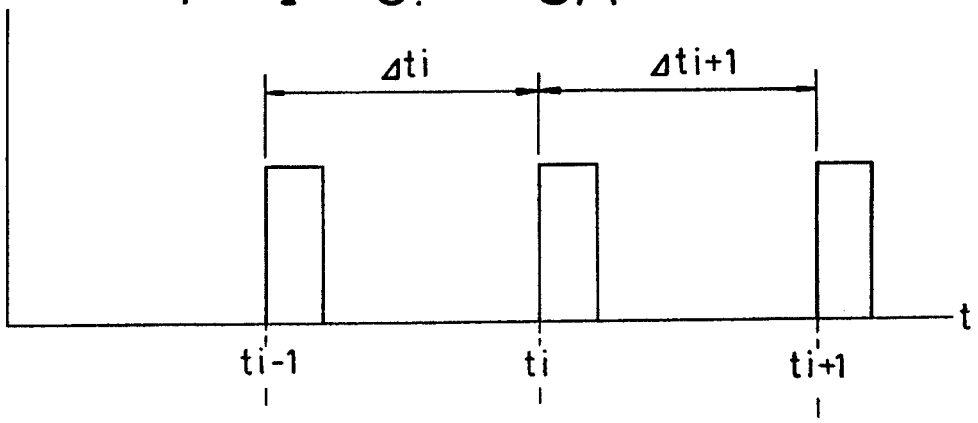
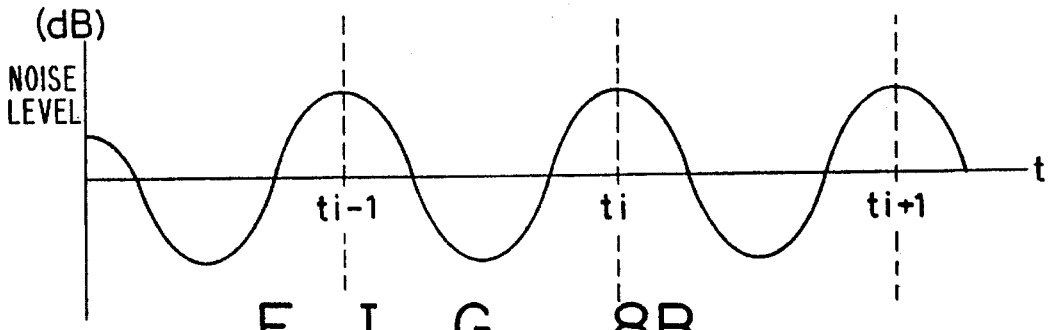
FIG. 8B
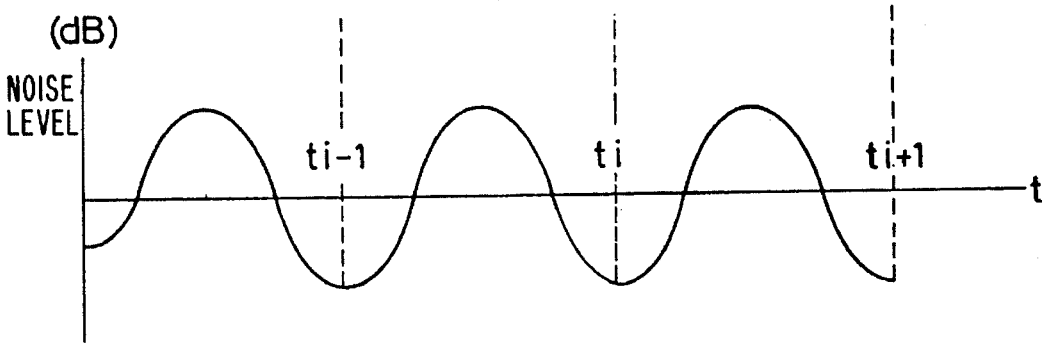
FIG. 8C

NOISE REDUCING APPARATUS OF A CYCLO-FAN

BACKGROUND OF THE INVENTION

1. Field of the Invention

The present invention is related to a noise reducing apparatus, and particularly to a noise reducing apparatus of a cyclo-fan that cancels a whistling noise generated by the cyclo-fan.

2. Description of the Prior Art

In general, a cyclo-fan may preferably be used for the purpose of reducing the size of an appliance because the suction and discharge directions of the air flowing therethrough are opposite to each other. Furthermore, the cyclo-fan is widely used as an air circulating means or a cooling means in various appliances including an air conditioner because the amounts of air increase in proportion to the axial length thereof.

As is well known, the air conditioner is an appliance that either absorbs heat from a definite space (in a cooling mode) or discharges heat to a definite space (in a heating mode), by using refrigerant as the working fluid in the refrigerating cycle comprising a compressor, an outdoor heat exchanger, an expansion valve, and an indoor heat exchanger.

FIG. 1 is a schematic cross sectional view showing a conventional indoor unit of an air conditioner.

Referring to FIG. 1, the indoor unit of an air conditioner conventionally comprises an indoor heat exchanger 115 diagonally extended across a housing 110, an air inlet 112 formed in the wall of the housing 110 lying over the indoor heat exchanger 115, an air outlet 113 arranged at the lower-front side of the housing 110, and a cyclo-fan arranged in the vicinity of the air outlet 113 lying under the indoor heat exchanger 115.

In the afore-mentioned configuration, relatively warm air (in a cooling mode) or cool air (in a heating mode) in a definite space flows into the housing 110 through the air inlet 112 by the action of the cyclo-fan 111 while the air conditioner is in operation. The heat of this air is then exchanged with that of the cool refrigerant (in a cooling mode) or the hot refrigerant (in a heating mode) flowing into the indoor heat exchanger 115, and then discharged through the air outlet 113, thereby decreasing or increasing the room temperature.

A stabilizer 114 is secured next to the air outlet 113 in the housing 110 for efficient discharge of the air circulated by the cyclo-fan 111. The narrower the spacing between the stabilizer 114 and the cyclo-fan 111, the greater the amount of air discharged.

On the other hand, the cyclo-fan 111 generates a whistling noise at a specific frequency value of NZ, which is determined by the product of the rotations N per second (i.e. rps) and the number Z of blades 111*a* of the cyclo-fan 111.

FIG. 2 is a wave form showing the frequency characteristics of a whistling noise generated by a conventional cyclo-fan.

Assuming that the rotation rate N of the cyclo-fan 111 is 20 revolutions per second (1200 rpm) and the number Z of blades 111*a* of the cyclo-fan 111 is 35, the pressure level of the whistling noise abruptly increases at a frequency of 700 Hz as shown in FIG. 2. Furthermore, the pressure level of the whistling noise becomes higher as the spacing between the cyclo-fan 111 and the stabilizer 114 becomes narrower, which acts as a restrictive factor when attempting to increase the amount of discharged air.

On the other hand, the overall noise generated by the indoor unit of an air conditioner is also caused by mechanical vibrations of the cyclo-fan 111 itself, by vibrations in the air path system, and by vibrations in a refrigerant pipe line or the like. An apparatus for reducing this overall noise is disclosed in Japanese Patent Laid-Open No. 4-281125 (Oct. 6, 1992). The disclosed apparatus includes two microphones for collecting the overall noise, two amplifiers for amplifying the overall noise collected by the microphones in an electrical manner, a main controller for producing an interference sound signal having a reverse phase and same amplitude (same sound pressure) as the overall noise, and two speakers for generating the interference sound cancel-out the overall noise. However, the disclosed apparatus has a problem in that it requires complicated circuits that include an additional signal analysis circuit because it is the overall noise being eliminated, thereby raising the manufacturing cost of the air conditioner.

SUMMARY OF THE INVENTION

It is an object of the present invention to provide a noise reducing apparatus for eliminating a peculiar noise (e.g., whistling noise) generated by a cyclo-fan with a simple configuration.

It is another object of the present invention to provide a noise reducing apparatus for eliminating the peculiar noise generated by the cyclo-fan adapted to an indoor unit of an air conditioner, thereby providing an agreeable environment and increasing the amount of air discharged from the indoor unit without restriction by the peculiar noise.

To achieve these objects, the noise reducing apparatus of the present invention comprises a cyclo-fan means including a plurality of arc-shaped blades radially disposed relative to a center axis thereof, and a couple of supporting members supporting opposite ends of the respective blades; a means for sensing the passage of the respective blade past a fixed position; a control means for calculating the frequency and pressure level of a peculiar noise generated by the cyclo-fan means based on the signal transmitted from the sensing means, and generating an electric signal corresponding to an interference sound having reverse phase and same pressure level as that of the peculiar noise; and a means for converting the electric signal generated from the control means into an interference sound.

In the noise reducing apparatus described above, the sensing means includes a plurality of light reflecting members provided on one of the two supporting members, each reflect member aligned with a respective blade, and a photo coupler formed of a light emitting element and a light receiving element.

There may be fewer light reflecting members.

The photo coupler may be arranged to face the supporting member a predetermined spacing therefrom, and is preferably secured to an air guiding means (hereinafter, called a stabilizer) which is arranged in the vicinity of the cyclo-fan means thereby increasing the amount of air discharged from the cyclo-fan means. In this case, the sound generating means may be also secured to the stabilizer.

The sound generating means may be preferably embodied by a speaker.

The control means calculates the frequency of the peculiar noise by multiplying the rotation rate of the cyclo-fan means by the number of fan blades. Furthermore, the pressure level of the peculiar noise is varied in proportion to the rotation rate of the cyclo-fan means and the spacing between the cyclo-fan means and the stabilizer. The latter value may be given as a constant value.

BRIEF DESCRIPTION OF THE DRAWINGS

The present invention will become more readily apparent from the following description in connection with the accompanying drawings wherein.

DETAILED DESCRIPTION OF THE PREFERRED EMBODIMENT

For a better understanding of the present invention, together with other and further objects, advantages and capabilities thereof, reference is made to the following disclosure in connection with the above-described drawings.

Figure 1:
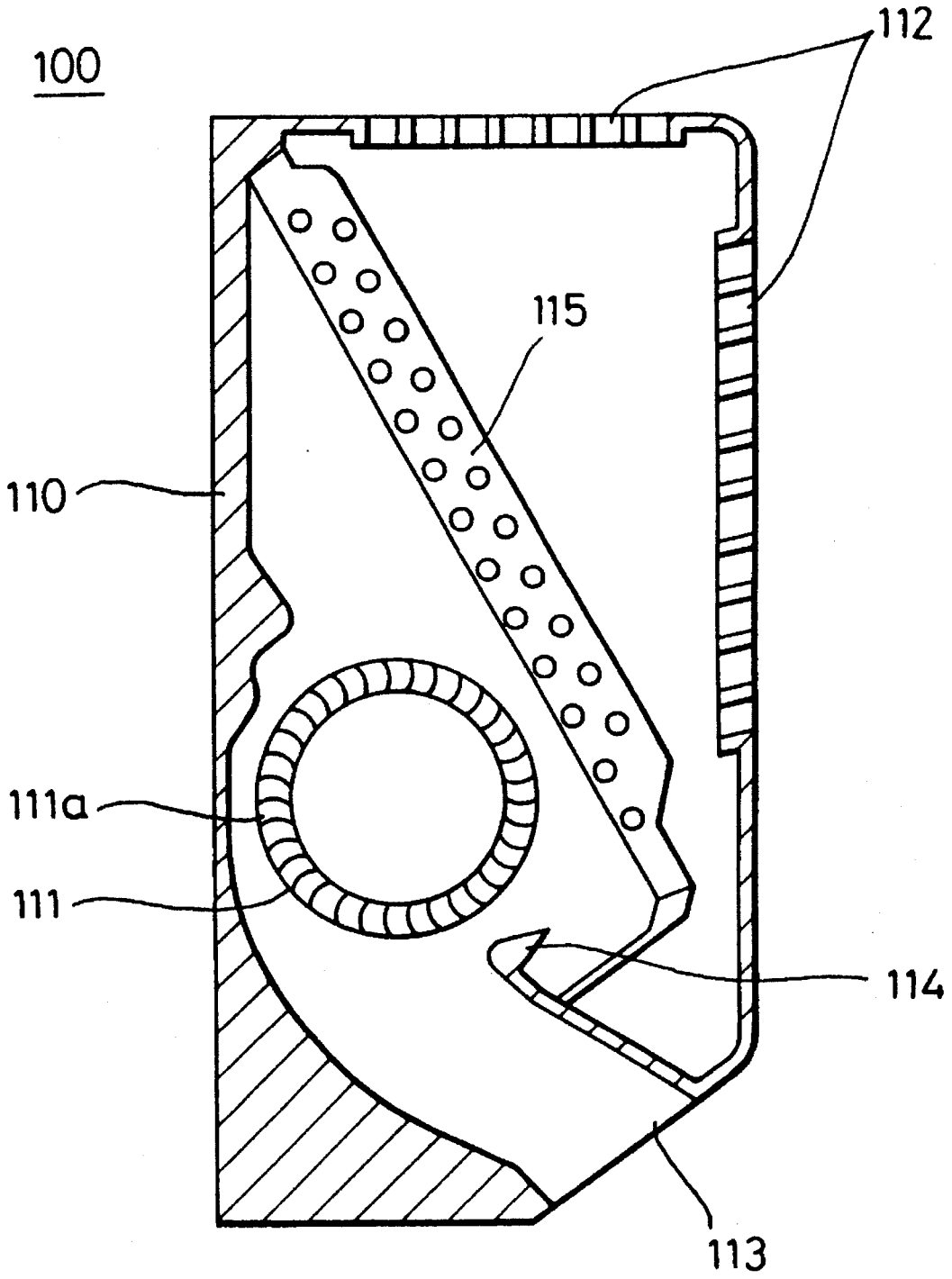
FIG. 1 (PRIOR ART)
FIG. 1 is a schematic cross sectional view showing a conventional indoor unit of an air conditioner.
Figure 2:
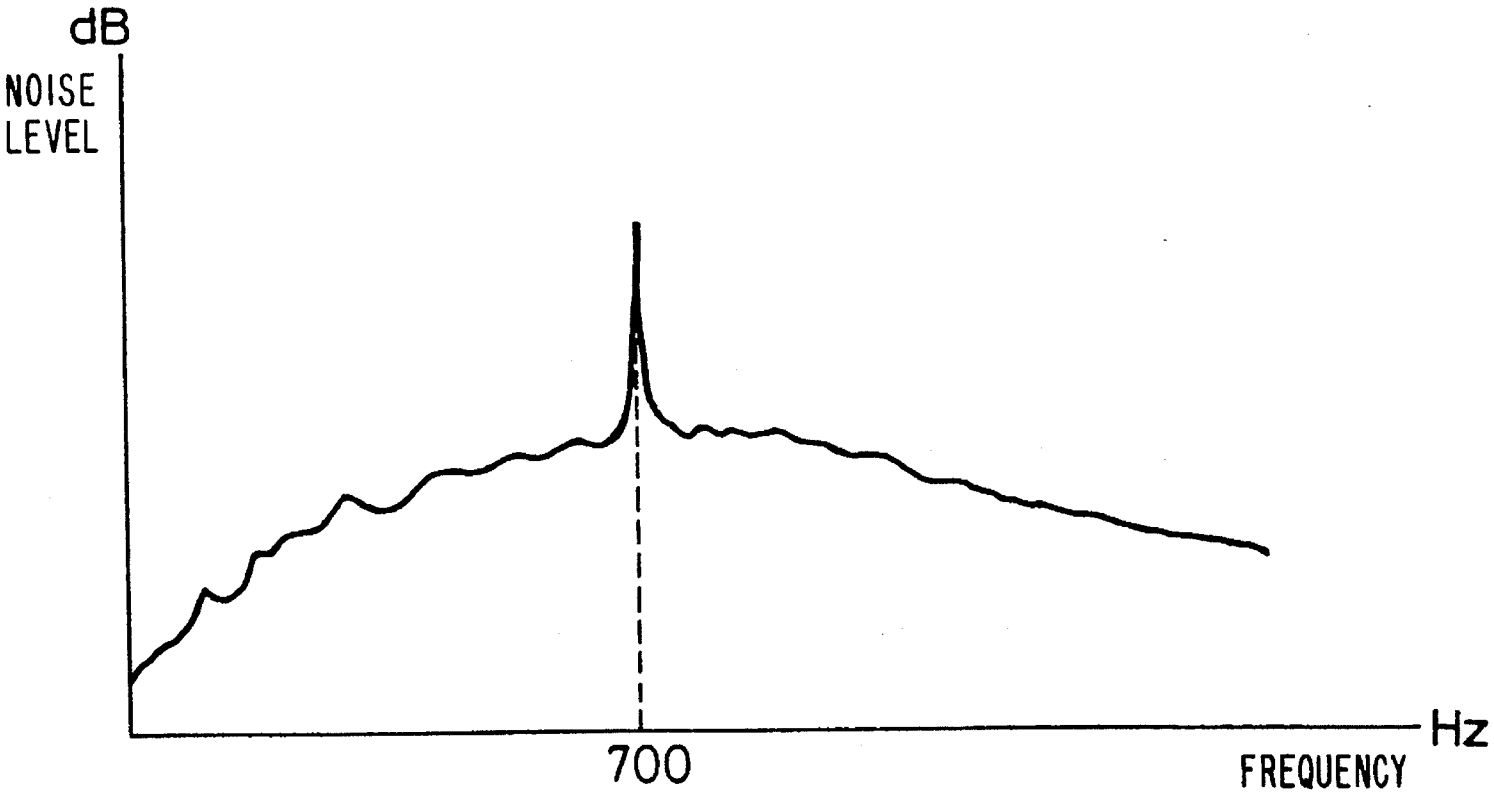
FIG. 2 (PRIOR ART)
FIG. 2 is a wave form showing the frequency characteristics of a peculiar noise generated by a conventional cyclo-fan.
Figure 3:
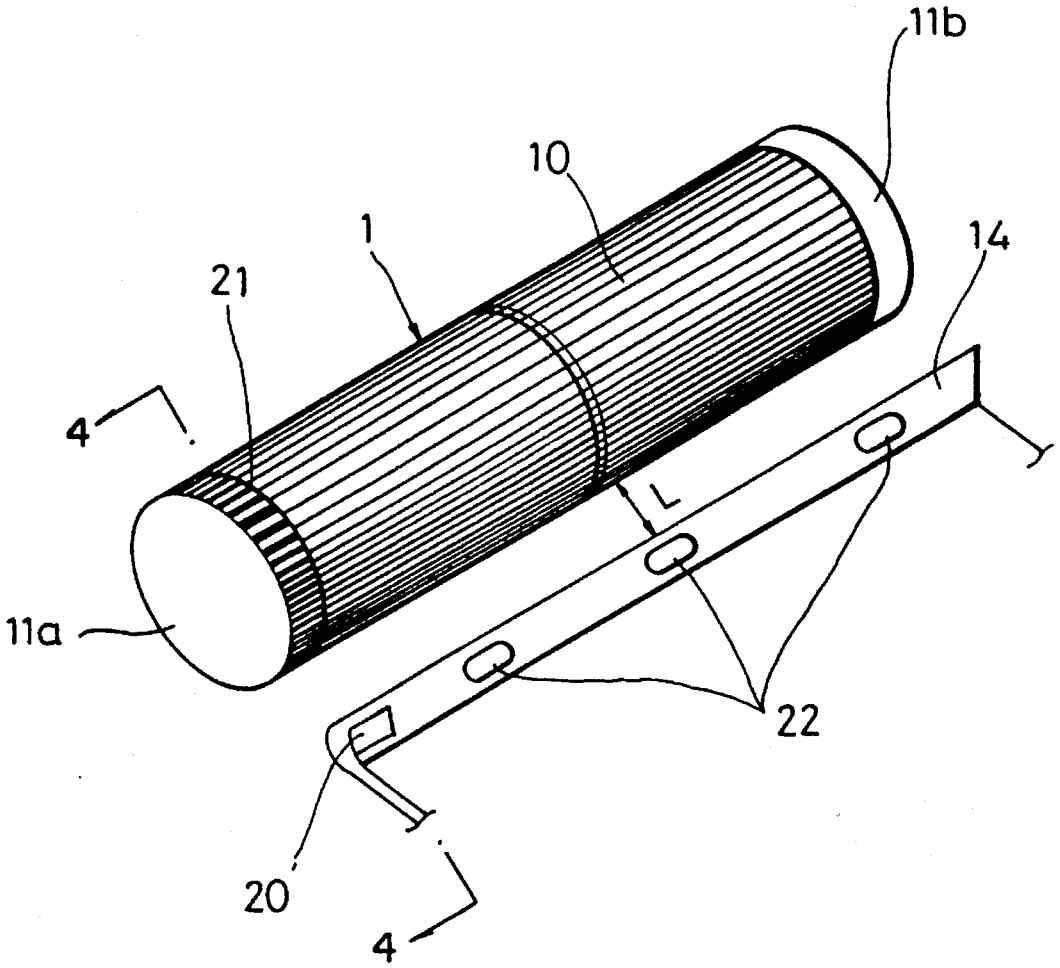
FIG. 3 is a perspective view showing a schematic configuration of a noise reducing apparatus of a cyclo-fan according to the present invention.
Figure 4:
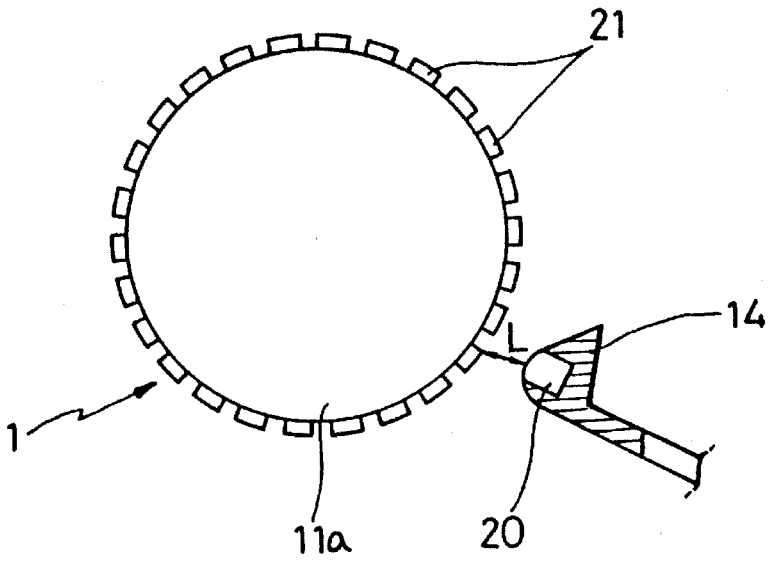
FIG. 4 is a cross sectional view taken along a line 4—4 in FIG. 3.

Referring to FIGS. 3 and 4, a cyclo-fan 1 includes a plurality of arc-shaped blades 10, whose ends are both supported by supporting members 11*a* and 11*b*. A plurality of light reflecting members 21 are attached to the surface of either supporting member 11*a* in line with the of the respective blades 10.

On the other hand, a stabilizer 14 is arranged in the vicinity of the cyclo-fan 1 along the axial direction of the cyclo-fan 1. A photo coupler 20, which is formed by a light emitting element and a light receiving element, is secured to the stabilizer 14 facing the supporting member 11*a* to which the light reflecting members 21 are attached. Three speakers 22 are also secured to the stabilizer 14 at regular intervals.

The photo coupler 20 and speakers 22 are electrically connected to the corresponding input and output terminals of a control section, not shown.

The control section receives a signal representative of the passage of the respective blade 10 from the photo coupler 20, and then calculates the rotation number per second (N/sec) of the cyclo-fan 1. The control section then calculates the frequency of the peculiar noise (hereinafter, called an NZ noise) of the cyclo-fan 1 by multiplying the rotation number (N/sec) and the number (Z) of blades 10. The control section also calculates the pressure level of the NZ noise, which is determined in proportion to both the rotation velocity of the cyclo-fan 1 and the straight distance L between the cyclo-fan 1 and the stabilizer 14, and then operates the speakers 22 with an electric signal having a reverse phase and same pressure level as the NZ noise subsequently canceling the peculiar noise.

Figure 5:
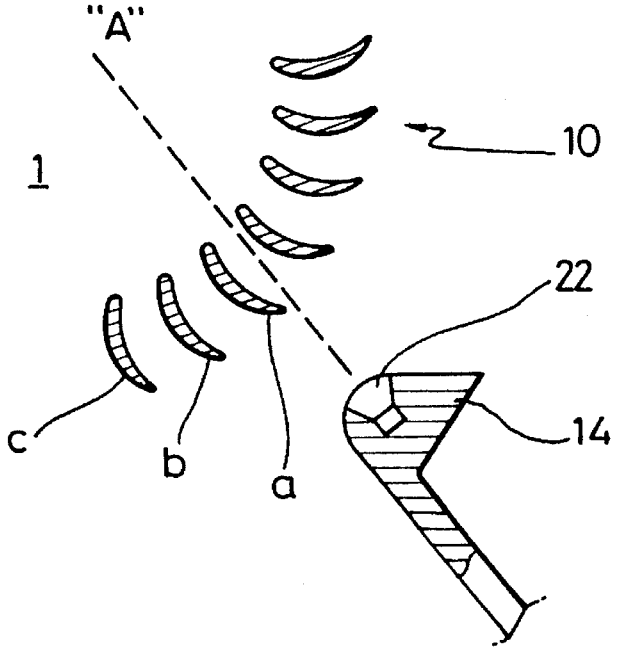
FIG. 5 is a schematic cross sectional view illustrating the operation principle of a noise reducing apparatus of a cyclo-fan according to the present invention.
Figure 6A:
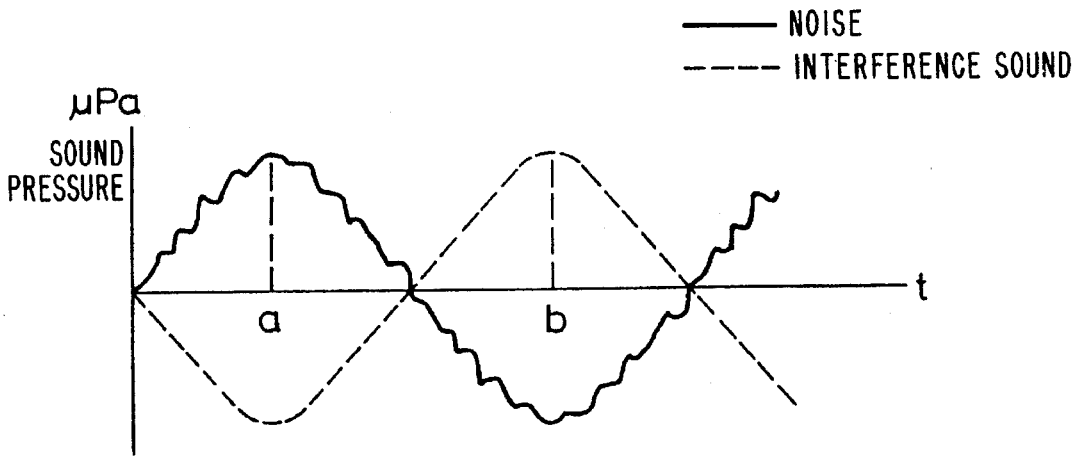
FIGS. 6A and 6B are wave forms illustrating the operation principle of a noise reducing apparatus of a cyclo-fan according to the present invention.

FIG. 5 is a schematic cross sectional view illustrating the operation principle of a noise reducing apparatus of a cyclo-fan according to the present invention. FIGS. 6A and B are wave forms illustrating the operation principle of a noise reducing apparatus of a cyclo-fan according to the present invention.

Figure 6B:
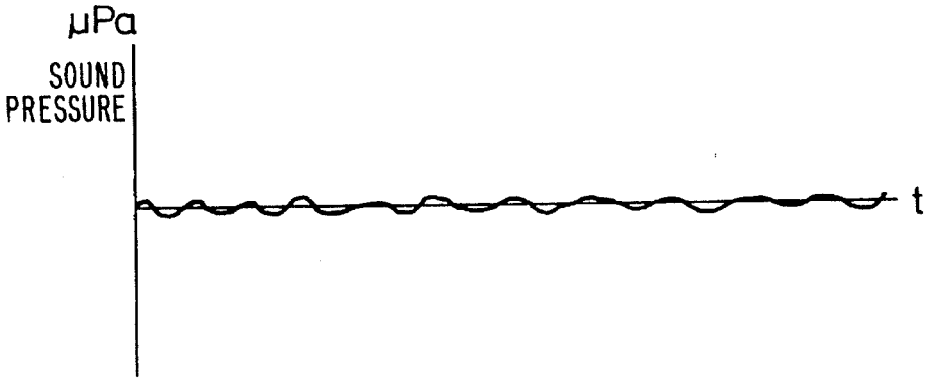

Referring to FIG. 5 and FIG. 6A, the pressure level of the NZ noise increases as the blade "a" approaches the stabilizer 14, whereas the pressure level of the NZ noise decreases as the blade "a" passes by the stabilizer 14. Repeatedly, the pressure level of the NZ noise increases as the blade "b" approaches the stabilizer 14, whereas the pressure level of the NZ noise decreases as the blade "b" passes by the stabilizer 14. These actions are continuously repeated while the cyclo-fan 1 is in rotation. Accordingly, if the speakers 22 generate an interference sound having a reverse phase and same pressure level as the NZ noise as shown by a dotted line in FIG. 6A, a so-called canceling interference phenomenon occurs, such that the NZ noise is canceled as shown in FIG. 6B.

Figure 7:
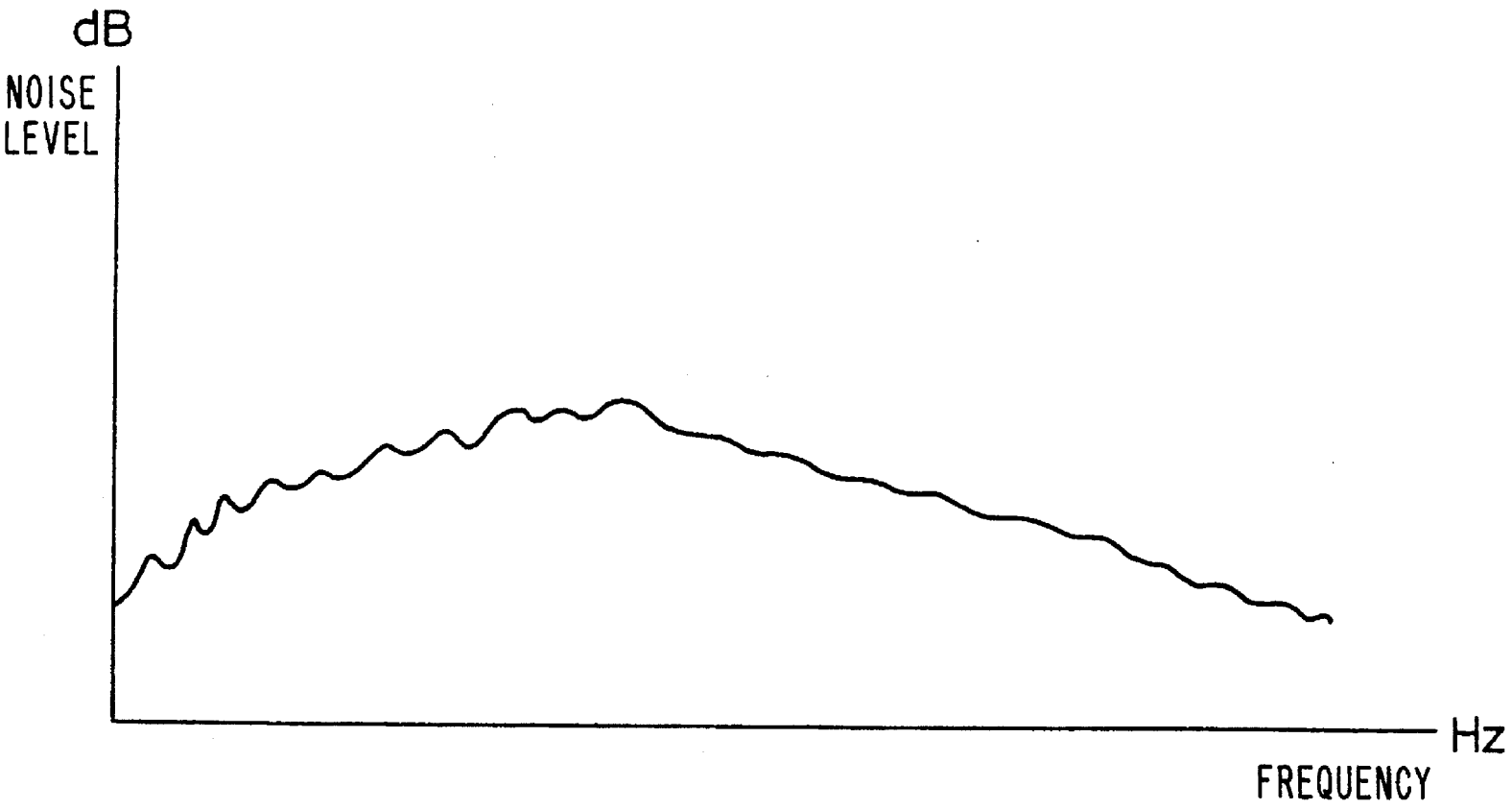
FIG. 7 is a wave form showing the frequency characteristics of the noise generated by an indoor unit of an air conditioner according to the present invention; and, FIGS. 8A to 8C are wave forms showing the phase relationships between the position sensor signal, the noise level, and the speaker sound level according to the present invention.

FIG. 7 is a wave form showing the frequency characteristics of the noise generated by an indoor unit of an air conditioner according to the present invention.

Referring to FIG. 7, it is found that the NZ noise is eliminated and only overall noise remains.

FIGS. 8A to C are wave forms showing the phase relationships between the position sensor signal, the noise level, and the speaker sound level according to the present invention.

Referring to FIGS. 8A to C, the light emitting element of the photo coupler 20 emits a light signal, for example, an infrared light signal. When the emitted light signal encounters the light reflecting members 21, the light signal is reflected back to the photocoupler 20, whereas when the emitted light signal encounters the rest of the supporting member 11*a*, that is light receiving member, it is absorbed therein. Thus a reflected light signal (pulse signal) is generated by the light receiving member of the photo coupler 20, and then transmitted to the control section.

The pulse signal as shown in FIG. 8A is transmitted to the control section through the light receiving element of the photo coupler 20. The control section counts the number of the pulse signals, and then calculates the rotations of the cyclo-fan 1 per second by using the following equation 1).

$$N=1/(\Delta t_i \times Z) \qquad 1)$$

where, $\Delta t_i = t_i - t_{i-1}$ (i.e., $\Delta t_i$ is the time separating successive pulse signals), and, Z is the number of the blades 10.

The control section then calculates the frequency of the peculiar noise produced by the cyclo-fan by multiplying the rotation number (N) and the number Z of the blades 10.

Some experimental data reveal that the pressure level of the peculiar noise varies in proportion to the rotation number (N) as follows: when the latter is 900 rpm, the former is 37 dB; when the latter is 1000 rpm, the former is 41 dB; when the latter is 1100 rpm, the former is 45.1 dB; and, when the latter is 1200 rpm, the former is 49.1 dB.

In addition, the pressure level of the peculiar noise may be expressed by using the following equations 2) and 3).

$$\text{Noise (dB)}=20 \log P/P_{ref} \quad 2)$$

where, $P_{ref}$ may be 20 μPa.

$$\text{Noise (dB)}=a\omega+b=c(1/\Delta t_i)+b \quad 3)$$

where, a, b and c are constant values which can vary, depending on the kind of appliance.

On the other hand, an equation 4) may be obtained by simultaneously solving equations 2) and 3) as follows.

$$P=A\ 10^{(B/\Delta ti)} \quad 4)$$

Furthermore, the pressure level of the peculiar noise is varied in the trace of a sinusoidal wave form (shown in FIG. 8B) whose magnitude is presumed to be maximum at the intervals $t_{i-1}$, $t_i$, and $t_{i+1}$ previously determined in the above-described manner (FIG. 8A). According to this, the control section produces an electric interference signal as shown in FIG. 8C and expressed by the following equation 5).

$$Pi=A\times 10^{(B/\Delta ti)} \cos(2\pi t/\Delta ti) \quad 5)$$

Next, the speakers 22 convert the electric interference signal produced by the control section into an interference sound, removing the peculiar noise.

In the afore-mentioned embodiment, end light reflecting member 21 is arranged in alignment with a respective blade 10, i.e., there is one member 21 per blade 10. However, fewer light reflecting member 21 may be provided, i.e., one member per a predetermined number of blades 10. In that case, the rotation number (N) of the cyclo-fan 1 is determined by the following equation 6).

$$N=M/(\Delta ti\times Z) \quad 6)$$

where, M equals the number of the blades divided 10 by the number of the light emitting members 21.

The noise reducing apparatus may preferably be adapted to an indoor unit of an air conditioner.

We claim:

1. A noise reducing apparatus in a cyclo-fan comprising:

a cyclo-fan including a plurality of arc-shaped blades extending generally parallel with respect to an axis of rotation, and a pair of supporting members spaced apart axially and supporting respective axial ends of said blades;

a fixed sensor for sensing a time interval between the passage of successive blades past said sensor during rotation of said blades and generating a signal indicative thereof;

a controller connected to said sensor for calculating the frequency and pressure level of an air flow noise generated by said cyclo-fan means, as a function of said signal from said sensing means, and then generating therefrom an electric interference having a reverse phase and same pressure level as said noise; and a sound generator for converting the electric interference signal generated by said controller into an interference sound for cancelling-out said noise;

said sensor comprising a plurality of light reflecting members attached to one of said supporting members and corresponding to respective ones of said blades, and a photo coupler arranged to face said one supporting member.

2. The apparatus according to claim 1, wherein said apparatus further comprises a guide surface disposed opposite said fan for guiding air generated by said cyclo-fan, said guide surface extending parallel to the axis of said cyclo-fan, said photo coupler and sound generator being secured to said guide surface.

3. The apparatus according to claim 1, wherein said frequency of said noise is determined by the product of the rotation rate of said cyclo-fan and the number of said blades.

4. The apparatus according to claim 1, wherein said cyclo-fan comprises part of an indoor unit of an air conditioner.

* * * * *